United States Patent [19]

Reynolds, Jr.

[11] Patent Number: 4,530,562

[45] Date of Patent: Jul. 23, 1985

[54] CONNECTOR

[75] Inventor: Frederick E. Reynolds, Jr., Warwick, R.I.

[73] Assignee: Electric Terminal Corporation, Warwick, R.I.

[21] Appl. No.: 501,772

[22] Filed: Jun. 7, 1983

[51] Int. Cl.[3] ..... H01R 13/50; H01R 11/22; H01R 13/11

[52] U.S. Cl. ..... 339/191 R; 339/192 R; 339/256 R; 339/258 F; 339/259 F

[58] Field of Search ..... 339/191 R, 191 M, 192 R, 339/256 R, 258 R, 258 F, 258 P, 259 R, 259 F

[56] References Cited

U.S. PATENT DOCUMENTS

| | | | |
|---|---|---|---|
| 3,058,091 | 10/1962 | Henschen | 339/259 R X |
| 3,120,990 | 2/1964 | Kinkaid | 339/259 F |
| 3,439,316 | 4/1969 | Evans | 339/192 R |
| 3,631,373 | 12/1971 | Matrisian | 339/256 R X |
| 3,836,947 | 9/1974 | Yeager | 339/259 R |

FOREIGN PATENT DOCUMENTS

| | | |
|---|---|---|
| 1454694 | 8/1965 | United Kingdom . |
| 1000223 | 12/1976 | United Kingdom . |

*Primary Examiner*—Gil Weidenfeld
*Assistant Examiner*—Steven C. Bishop

[57] ABSTRACT

An electrical contact for use in a receptacle comprising, a base portion, a pair of side portions extending from the base portion in the same direction and a pair of overhanging and overlapping portions extending from the side portions to define an insertion region with the side and base portions.

10 Claims, 4 Drawing Figures

CONNECTOR

FIELD OF THE INVENTION

The invention relates to an electrical contact for use in a receptacle for receiving plug prongs.

BACKGROUND OF THE INVENTION

Plug prong receptacles typically employ conductive contacts provided within plug prong receiving passages in a plastic housing. Many of these receptacles are designed to employ the resiliency of the plastic to provide the normal force between the contacts and plug prongs when plug prongs are inserted between opposing portions of a contacts.

SUMMARY OF THE INVENTION

I have discovered that by providing an electrical contact with a base portion, a pair of side portions, and a pair of overhanging and overlapping portions extending from the side portions to define an insertion region with the side and base portions, the contact itself provides reliable normal contact force between the contact and the plug prong, the prong biasing both overhanging portions when it is inserted.

In preferred embodiments the lower overhanging portion extends more than half of the distance from one side portion to the other side portion; the upper overhanging portion extends a shorter distance (most preferably about half way from one side portion to the other said portion) to reduce its moment arm to thereby increase the normal contact force; and the overhanging portions make acute angles with the side portions so that when a plug prong is inserted, they are both generally parallel to the base portion.

DESCRIPTION OF THE PREFERRED EMBODIMENT

I now turn to description of the structure and operation of the presently preferred embodiment of the invention after first briefly describing the drawings.

DRAWINGS

STRUCTURE

Figure 1:
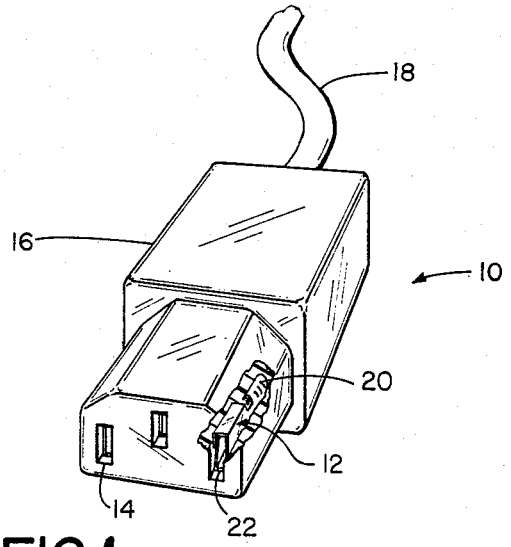
FIG. 1 is a perspective view, diagrammatic and partially broken away, of a plug prong receptacle according to the invention.

Referring to FIG. 1, there is shown plug prong receptacle 10 having three electrical contacts 12 within plug prong insertion passages 14 of plastic housing 16. Conductive wires within wire 18 are connected to contacts 12.

Figure 2:
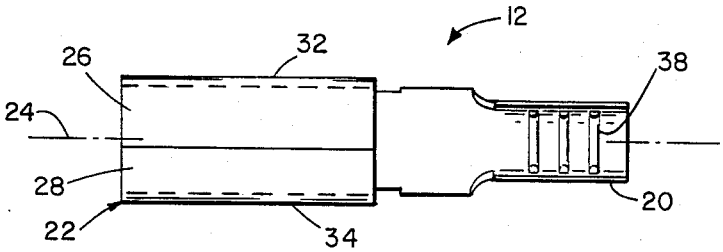
FIG. 2 is a plan view of an electrical contact for the FIG. 1 receptacle.
Figure 3:
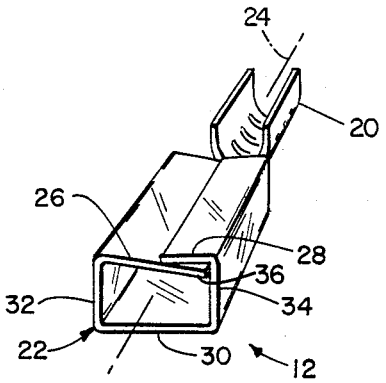
FIG. 3 is a diagrammatic perspective view of the FIG. 2 contact.
Figure 4:
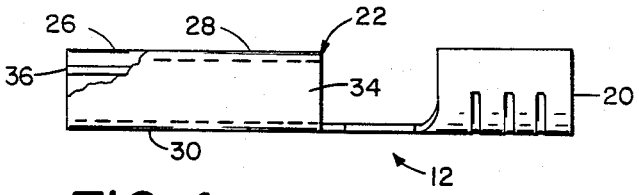
FIG. 4 is a side elevation, partially broken away, of the FIG. 2 contact.

Referring to FIGS. 2–4, each contact 12 has crimping end 20 for connection to wire 18 and insertion end 22 for receiving a plug prong inserted along insertion axis 24. End 20 has ribs 38 for making good electrical contact with wires 18 when it is crimped around wire 18.

Referring to FIG. 3, contact 12 is made from a single piece of 0.016 thick copper alloy. Insertion end 22 has overhanging portions 26, 28 extending from the upper ends of side portions 32, 34, which extend upward from base portion 30.

Side portions 32, 34 are parallel to each other and are spaced by 0.175 (+0.004−0.000)". Overhanging portion 26 extends inward from side portion 32 beginning at a point 0.082 (+0.002−0.000)" from the top of base portion 30 at an angle of 83° with side portion 32. Overhanging portion 28 extends inward 0.086" from side portion 34 beginning at a point 0.098 (+0.002−0.000)" above the top of base portion 30 at an angle of 81° with side portion 34. End 36 of overhanging portion 26 is 0.060" above the top of base 30.

OPERATION

In operation, a plug with three prongs aligned with passages 14 is mated with contact 10, one prong being inserted in each passage 14 along insertion axes 24. During insertion, both overhanging portions 26, 28 are biased upward with both portions contributing to the contact force on the plug prong. When the plug prong is completely inserted, overhanging portions 26, 28 will be generally parallel to base portion 30. Because overhanging portion 28 only extends about ½ the distance between side portions 32, 34, its moment arm bending it is short, and it provides a high downward normal force on the plug prong in insertion end 22. The normal contact forces provided by contact 12 do not vary with changes in temperature as much as forces provided by receptacles employing plastic to provide the contact forces.

OTHER EMBODIMENTS

Other embodiments of the invention are within the scope of the following claims.

What is claimed:

1. An electrical contact for use in a receptacle comprising, a flat base portion having a length and width, a pair of flat side portions extending from said base portion in the same direction and connected to said base portion at parallel fold lines along the length of said base portion, a first flat overhanging portion extending from the end of one side portion toward the other side portion at an acute angle to said one side portion to define an insertion region for receiving a plug prong with said base portion and said side portions, said first overhanging portion extending from and connected to said base portion at a fold line along the length of said one side portion, and a second flat overhanging portion extending from said other side portion toward said one side portion at an acute angle to said other side portion and overlapping a portion of said first overhanging portion, said second overhanging portion extending from and connected to said base portion at a fold line along the length of said other side portion, said base portion, side portions and first and second overhanging portions all being formed of the same sheet of metal, whereby a plug prong inserted in said region biases said first overhanging portion and said second overhanging portion through said first overhanging portion to provide good electrical contact along the length of said insertion region.

2. The electrical contact of claim 1 wherein said first overhanging portion extends more than ½ of the distance from said one side portion to said other side portion.

3. The electrical contact of claim 2 wherein said second overhanging portion extends a shorter distance than said first overhanging portion.

4. The electrical contact of claim 3 wherein said second overhanging portion extends about ½ of the distance from said other side portion to said one side portion.

5. The electrical contact of claim 1 wherein said contact also includes means to attach wires to one end of it.

6. A plug prong receptacle comprising a plastic housing having at least two parallel passages therein for receiving plug prongs, and electrical contacts within said at least two passages, said electrical contacts each comprising, a flat base portion having a length and width, a pair of flat side portions extending from said base portion in the same direction and connected to said base portion at parallel fold lines along the length of said base portion, a first flat overhanging portion extending from the end of one side portion toward the other side portion at an acute angle to said one side portion to define an insertion region for receiving a plug prong with said base portion and said side portions, said first overhanging portion extending from and connected to said base portion at a fold line along the length of said one side portion, and a second flat overhanging portion extending from said other side portion toward said one side portion at an acute angle to said other side portion and overlapping a portion of said first overhanging portion, said second overhanging portion extending from and connected to said base portion at a fold line along the length of said other side portion, said base portion, side portions and first and second overhanging portions all being formed of the same sheet of metal, whereby a plug prong inserted in said region biases said first overhanging portion and said second overhanging portion through said first overhanging portion to provide good electrical contact along the length of said insertion region.

7. The plug prong receptacle of claim 6 wherein said first overhanging portion extends more than ½ of the distance from said one side portion to said other side portion.

8. The plug prong receptacle of claim 7 wherein said second overhanging portion extends a shorter distance than said first overhanging portion.

9. The plug prong receptacle of claim 8 wherein said second overhanging portion extends about ½ of the distance from said another side portion to said one side portion.

10. The electrical contact of claim 6 wherein said contact also includes means to attach wires to one end of it.

* * * * *